US008083058B2

(12) United States Patent
Marcinkowski et al.

(10) Patent No.: US 8,083,058 B2
(45) Date of Patent: Dec. 27, 2011

(54) CONSUMER PRODUCT PACKAGE WITH STABILIZING INSERT

(75) Inventors: Stanley Michael Marcinkowski, Peabody, MA (US); Richard Kevin Sennett, Abington, MA (US)

(73) Assignee: The Gillette Company, Boston, MA (US)

( * ) Notice: Subject to any disclaimer, the term of this patent is extended or adjusted under 35 U.S.C. 154(b) by 72 days.

(21) Appl. No.: 12/788,821

(22) Filed: May 27, 2010

(65) Prior Publication Data

US 2011/0290688 A1 Dec. 1, 2011

(51) Int. Cl.
*B65D 5/52* (2006.01)

(52) U.S. Cl. ..... 206/352; 206/45.24; 206/461; 206/764; 206/765; 53/467; 53/484

(58) Field of Classification Search ..... 206/45.24, 206/45.25–45.27, 228, 351, 352, 461, 471, 206/764–766, 774; 53/467, 471, 473, 484; 30/32, 34.05; 220/628, 631, 636; 426/110, 426/115, 120

See application file for complete search history.

(56) References Cited

U.S. PATENT DOCUMENTS

| | | | | |
|---|---|---|---|---|
| 1,825,332 | A * | 9/1931 | Benbow | 206/45.24 |
| 2,937,746 | A | 5/1960 | Ferguson | |
| 3,093,244 | A * | 6/1963 | Middleton, Jr. et al. | 206/45.24 |
| 3,785,546 | A | 1/1974 | Kuster | |
| 4,842,141 | A | 6/1989 | Segal | |
| 4,962,849 | A * | 10/1990 | Anderson | 206/45.24 |
| 5,011,006 | A | 4/1991 | Anderson | |
| 5,407,066 | A * | 4/1995 | Grange | 206/228 |
| 5,429,241 | A * | 7/1995 | Althaus | 206/471 |
| 5,564,569 | A * | 10/1996 | Kiefer | 206/461 |
| 5,657,874 | A | 8/1997 | Hustad et al. | |
| 5,900,263 | A | 5/1999 | Gics | |
| 6,276,529 | B1 * | 8/2001 | Feehan, Jr. | 206/469 |
| 7,207,441 | B2 | 4/2007 | Ritter | |
| 7,281,630 | B2 * | 10/2007 | Hartman et al. | 206/467 |
| 7,410,056 | B2 | 8/2008 | Cafferata et al. | |
| 7,624,859 | B1 * | 12/2009 | Casanova et al. | 206/45.24 |
| 2007/0029223 | A1 | 2/2007 | Mazurek | |
| 2008/0029417 | A1 | 2/2008 | Begim | |

FOREIGN PATENT DOCUMENTS

| | | |
|---|---|---|
| FR | 1 590 511 A | 4/1970 |
| FR | 2 920 748 | 3/2009 |

OTHER PUBLICATIONS

PCT International Search Report with Written Opinion in corresponding Int'l appln. PCT/US2011/036895 dated Aug. 22, 2011.

* cited by examiner

*Primary Examiner* — Luan K Bui
(74) *Attorney, Agent, or Firm* — John M. Lipchitz; Kevin C. Johnson; Steven W. Miller

(57) ABSTRACT

A consumer product package having a tub with a base and a perimeter wall defining a cavity in communication with an opening that extends through the perimeter wall. A consumer product is disposed within the cavity and a stabilizing insert is at least partially disposed within the cavity. The stabilizing insert has a retaining member removably secured the consumer product and a support member with a foot extending through the opening of the perimeter wall to facilitate positioning the tub in a substantially upright position.

20 Claims, 7 Drawing Sheets

CONSUMER PRODUCT PACKAGE WITH STABILIZING INSERT

FIELD OF THE INVENTION

The present invention relates to display packages for food or consumer goods and more particularly, to consumer product packages having a stabilizing insert adapted to support the package in a substantially upright position on a support surface (such as on a product display or a store shelf) as a freestanding package.

BACKGROUND OF THE INVENTION

Blister-type packages are popular for storing and displaying articles for sale. The two primary components of a blister pack are the cavity or pocket made from a formable material, (e.g., plastic) and a lid (e.g., paperboard or plastic). The formed cavity or pocket contains the product and the lid seals the product within the cavity. Other types of blister packs may consist of carded packages where the products are contained between a paperboard card and clear pre-formed plastic (e.g., polyvinylchloride). The consumer can easily examine the product through the transparent plastic. The plastic shell is vacuum-formed around a mold so it can contain the item snugly. The card may be brightly colored and designed depending on the item inside, and the pre-formed plastic is affixed to the card using heat and pressure to activate an adhesive (heat seal coating) on the blister card. The adhesive is strong enough so that the pack may hang on a peg, but weak enough so that the package can be easily opened. The card may also have a perforated window for access. A more secure package is known as a clamshell. It is often used to deter package pilferage for small high-value items such as consumer electronics. It consists of either two pre-formed plastic sheets or one sheet folded over onto itself and fused at the edges. They are usually designed to be difficult to open by hand so as to deter tampering. A pair of scissors or a sharp knife is often required to open them. Care must be used to safely open some of these packages.

Blister packs are typically thermoformed. Thermoforming is a manufacturing process where a plastic sheet is heated to a pliable forming temperature, formed to a specific shape in a mold, and trimmed to create a usable product. The sheet (or film when referring to thinner gauges and certain material types), is heated in an oven to a high-enough temperature that it can be stretched into or onto a mold and cooled to a finished shape. For high-volume applications, very large production machines are utilized to heat and form the plastic sheet and trim the formed parts from the sheet in a continuous high-speed process, and can produce many thousands of finished parts per hour depending on the machine and mold size and the size of the parts being formed.

Consumers have been demanding environmentally friendly changes in food and consumer product packaging, such as minimizing the use of plastic and other non renewable materials. Many consumers are concerned about the environmental impact of packaging. Researchers believe that global green initiatives have strongly influenced this consumer attitude. Researchers also believe this new consumer attitude that will continue to push packaging manufacturers into finding environmentally friendly packaging alternatives. Typical plastics take an extended period of time to compost (break down) in a land fills. New environmentally friendly packaging materials are made from renewable materials that can be grown quickly (unlike most trees). Renewable materials may be recyclable and/or biodegradable. Several alternatives to plastics have been developed for thermoforming blister packs and trays, such as, paper board and renewable plant fiber. Despite the environmental advantages of these materials, current manufacturing processes (e.g., thermoforming) often limit the design and functionality of the final package. For example, the blister pack may require multiple angled sides because of draft angle requirements in order to remove the pack from a mold or tool during manufacturing. Graphics to draw a consumer's attention are often placed on the front of the package, thus it is advantageous for the pack to be positioned vertically in a substantially upright position so the consumer can see the graphics on the front of the package. Due to manufacturing limitations, the formed pack may not be displayed properly (e.g., vertically in a substantially upright position) on a shelf resulting in no consideration by a consumer or retailer and thus a missed sale. In addition, many irregular shaped packages do not provide for proper facing. For example, an oblong or circular package may not stand in an upright position by itself. Accordingly the consumer may not see the front panel of the package unless it is being suspended from a display peg or hook.

SUMMARY OF THE INVENTION

In one aspect, the invention features, in general, a consumer product package having a tub with a base and a perimeter wall defining a cavity in communication with an opening that extends through the perimeter wall. A consumer product is disposed within the cavity and a stabilizing insert is at least partially disposed within the cavity. The stabilizing insert has a retaining member removably secured to the consumer product and a support member with a foot extending through the opening of the perimeter wall to facilitate positioning the tub in a substantially upright position.

In another aspect, the invention features, in general, a package for a shaving razor having a tub with a base, an outer flange member, and a perimeter wall. The perimeter wall defines an opening and tapers inward from the outer flange member to the base. A shaving razor is disposed within the tub. A stabilizing insert with a support member having a foot extends through the opening of the perimeter wall such that the outer flange member and the foot support the tub in a substantially upright position.

In yet another aspect, the invention features, in general, a method of packaging a consumer product. The method has a step of at least partially securing a portion of a consumer product to a retaining member of a stabilizing insert having a support member with a foot. The stabilizing insert is placed within a tub having a base and a perimeter wall with a hole extending through the perimeter wall. The stabilizing insert is placed into the tub and the foot is inserted through the hole in the perimeter wall.

DETAILED DESCRIPTION OF THE INVENTION

Figure 1:
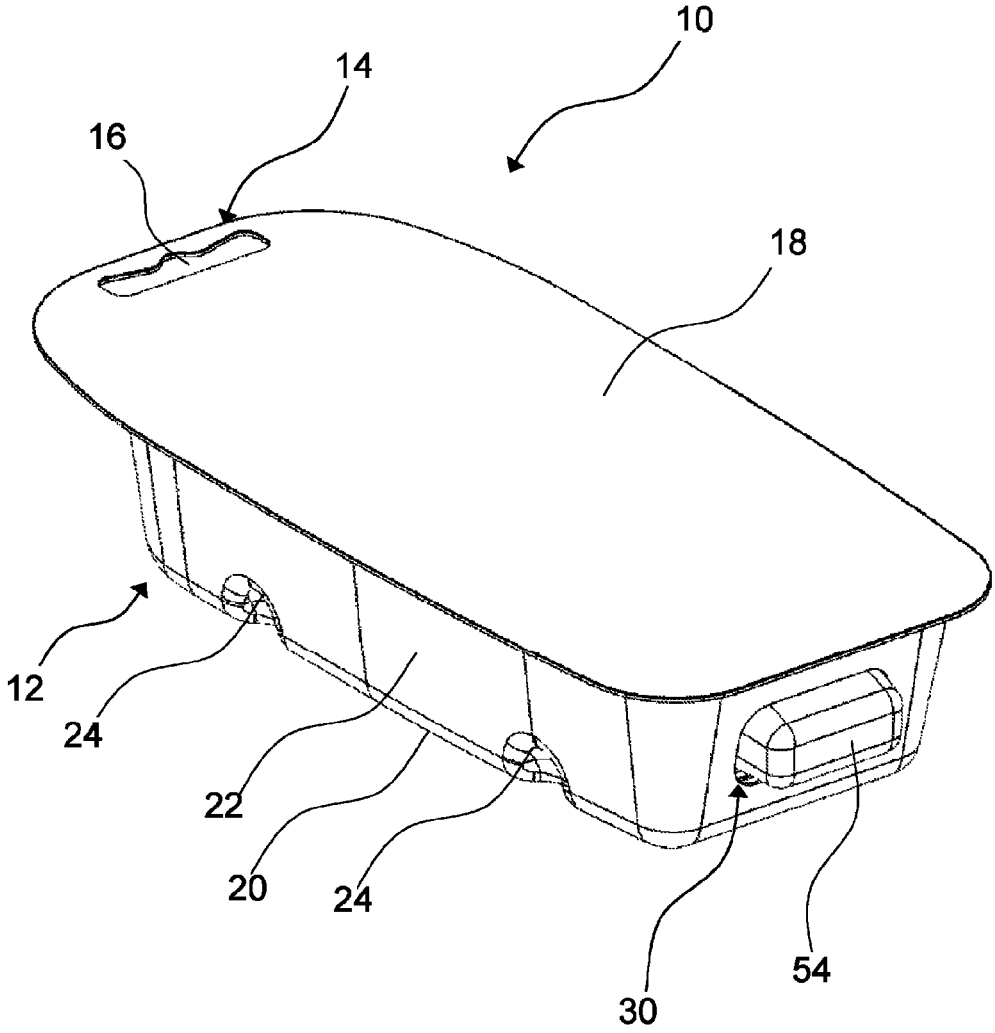
FIG. 1 is a perspective view of a consumer product package having a cover.

Referring to FIG. 1, one possible embodiment of the present invention is shown illustrating a consumer product package 10, which may be mounted to a hanging display (e.g., a peg board) and/or displayed on a store shelf. It is understood that the consumer product package 10 may include any type of blister packs, including, but not limited to card blisters and clamshells. The consumer product package 10 may include a tub 12 for holding and displaying one or more food or consumer articles and a cover 18 affixed to the tub 12. In certain embodiments, the tub 12 may be formed from paperboard and/or renewable materials (e.g., bulrush, wheat stalk, rice hull, bamboo, and combinations thereof available from BGreen Packaging LLC, Santa Barbara, Calif.). The tub 12 may be the natural color of the paperboard and/or renewable material or may alternatively contain a dye (e.g., orange or blue) for enhanced consumer appeal. The cover 18 may be transparent and/or translucent such that a consumer can see the articles disposed within the tub 12. In certain embodiments, the cover 18 may be injection molded or thermoformed from a clear polymer material, including, but not limited to polyvinyl chloride (PVC), polyethylene terephthalate (PET), high density polyethylene (HDPE), and low density polyethylene (LDPE), polypropylene (PP), or any combination thereof. Alternatively, the cover 18 may include a flat or formed paperboard or polymeric material with a heat sealable coating and/or an anti-theft coating. The cover 18 may also include thin polymeric films that are sealed to the tub 12. The tub 12 may comprise similar of different materials as the cover 18. The demand for environmentally packaging materials is constantly increasing. Currently it is difficult to manufacture packages (e.g., blister packs) from environmentally packaging materials (e.g., paperboard or renewable plant fibers) with features to support the package in a vertical and substantially upright position. Unlike polymeric materials, materials such as paperboard or renewable plant fibers have manufacturing limitations which limit the shape and design of the package.

The tub 12 may have a base 20 and a perimeter wall 22 configured to receive one or consumer products. The perimeter wall 22 may have a plurality of nesting members 24 For example, the nesting members 24 may include recesses and/or protrusions located at a junction of the base 20 and the perimeter wall 22. The nesting members 24 may provide a gap between the tubs 12 when they are stacked together during shipping and storage. The gap allows the packs 12 to be separated easily with minimal damage to the tub 12. As will be explained in greater detail below, the perimeter wall 22 of the tub 12 may define an opening 30 that is dimensioned to receive a foot 54 to support the consumer product package 10 in a substantially upright and vertical position (e.g., free-standing) on a support surface (such as on a product display or on a store shelf).

In certain embodiments, the tub 12 may have a hanging member 14 to facilitate the displaying (e.g., centering) the consumer product package 10 on a hanging display. Hanging displays, such as peg boards offer increased versatility for presenting articles to consumers. For example, pegboard racks that revolve or spin work extremely well for stores that have limited floor space. The hanging member 14 may have an opening 16 extending therethrough that is dimensioned to receive a peg or hook of a peg board style display. The opening 16 may be circular, a slot, or any other geometry known to those skilled in the art for easy placement of the tub 12 on a peg or hook. The hanging member 14 may have other configurations, such as a hook, to facilitate the mounting of the consumer product package 10 to a string or wire. The hanging member 14 may be integral with the tub 12 or may be a separate member that is joined (e.g., adhesives) to the tub 12. Although the opening 16 is shown extending through the hanging member 14, it is understood that the hanging member 14 is part of the tub 12 and the opening 16 may extend directly through the tub 12. In other embodiments, the consumer product package 10 may not have a hanging member 14 (e.g., the consumer product package 10 may be displayed on a store shelf and not on a peg board).

Figure 2A:
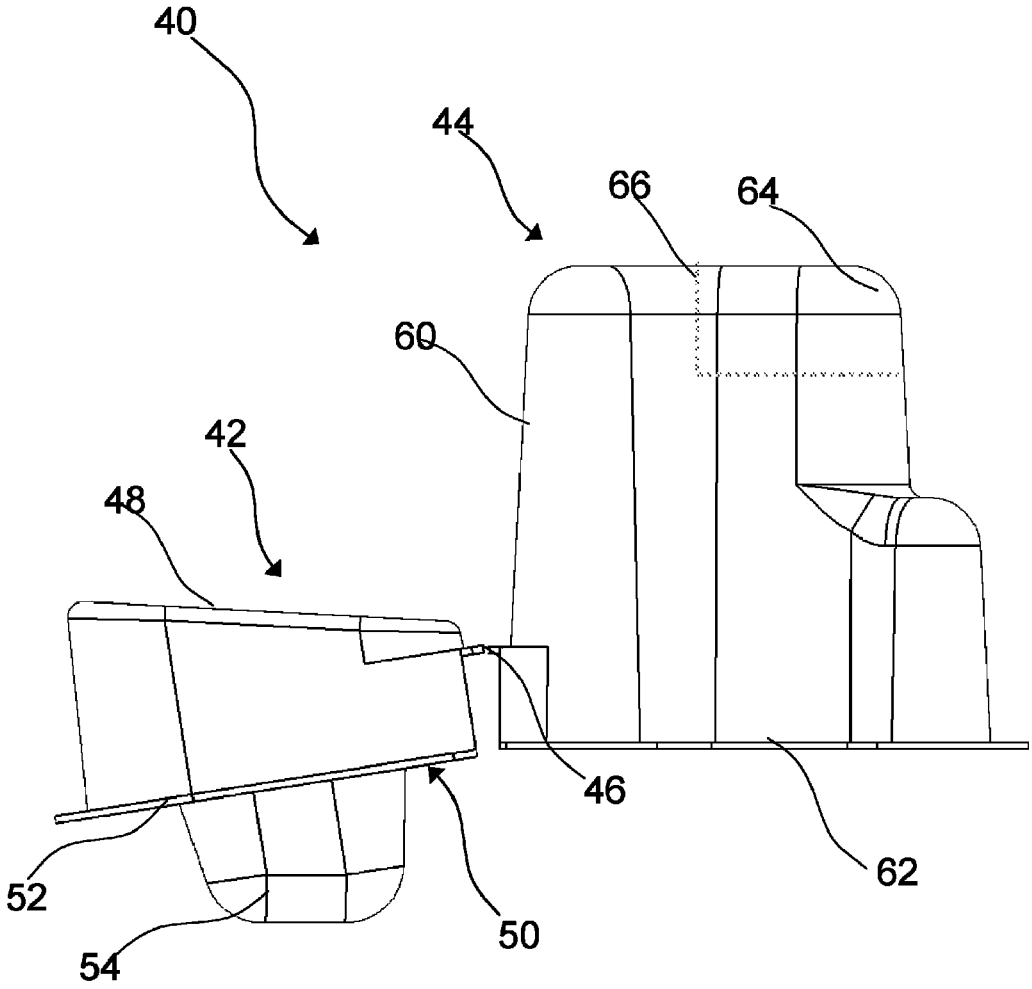
FIG. 2A is a side view of a stabilizing insert that may be incorporated into the display package of FIG. 1.
Figure 2B:
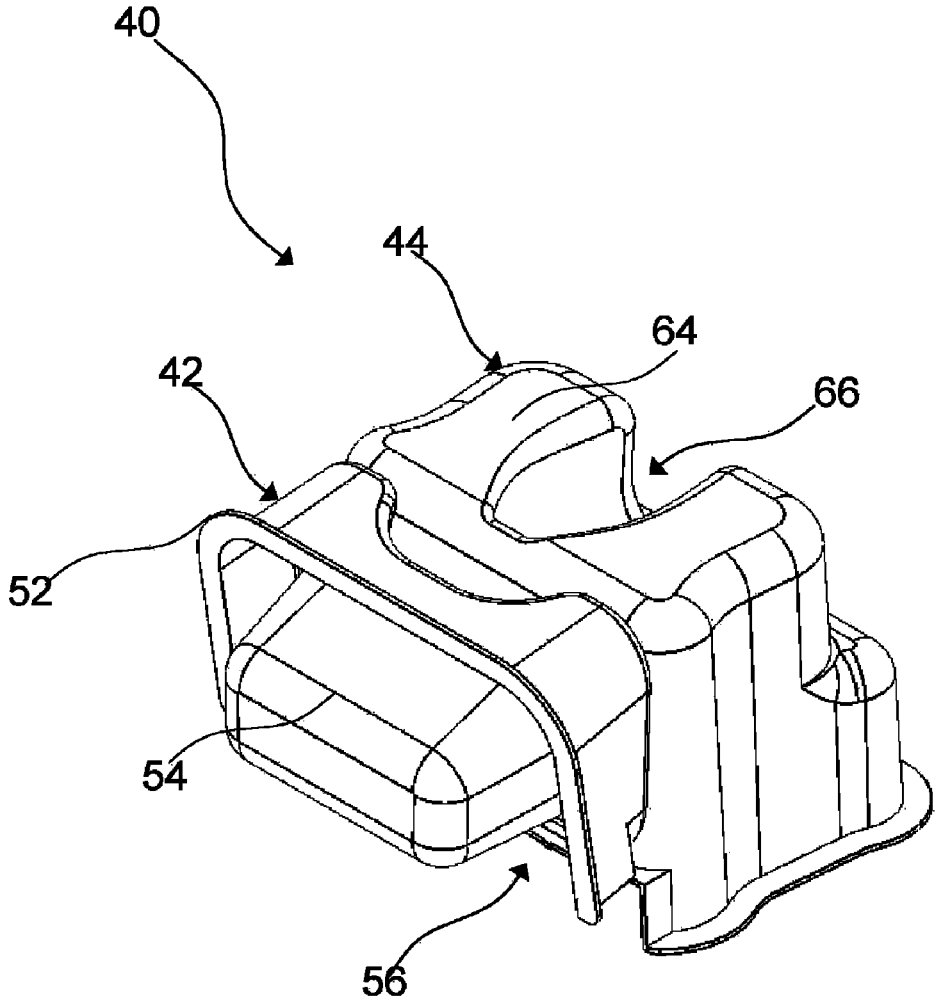
FIG. 2B is a perspective view of the stabilizing insert of FIG. 2A in a second position.

Referring to FIGS. 2A and 2B a side view of and a perspective view of the stabilizing insert 40 is illustrated, respectively. The stabilizing insert 40 may be a separate component that is placed within the tub 12 to allow the tub 12 and/or the stabilizing insert 40 to be properly recycled. For example, if the tub 12 in made from plant fiber and the stabilizing insert 40 is made from plastic, a consumer can easily separate and recycle the stabilizing insert 40 with other plastics and compost the tub 12 by itself. The stabilizing insert 40 may include a support member 42 and an optional retaining member 44 (e.g., the support member 42 may be used independently of the retaining member 44). The support member 42 may have a lower surface 50 and an upper surface 48. The lower surface 50 of the support member 42 may have a flange 52 and a foot 54. As best shown in FIG. 2B, the foot 54 may be spaced apart from the flange 52 to provide a gap 56 extending around the foot 54. The retaining member 44 may have a side surface 60 and a base 62 generally transverse to the side surface 60. A top surface 64 of the retaining member 44 may define a recess 66 extending into the top surface 64 that is dimensioned to receive and hold at least a portion of one or more consumer products (not shown).

The stabilizing insert 40 (e.g., the support member 42 and/or the retaining member 44) may be thermoformed or injection as two separate units or a single unit. For example, the stabilizing insert 40 may be molded or thermoformed as a single unit with a hinge 46 (e.g., a living hinge or a thin piece of material) interconnecting the support member 42 and the retaining member 44. The stabilizing insert 40 (e.g., the support member 42 and/or the retaining member 44) may be molded from a polymeric materials including, but not limited to polyethylene, polypropylene, polyvinyl chloride, polyethylene terephthalate, and any combination thereof. The stabilizing insert 40 (e.g., the support member 42 and/or the retaining member 44) may also be manufactured from renewable plant fibers or paperboard. The stabilizing insert 40 may be initially manufactured in a first configuration, as shown in FIG. 2A. In a subsequent assembly operation, the stabilizing insert 40 may be flexed into a second configuration, as shown in FIG. 2B. The hinge 36 may facilitate the bending of the stabilizing insert 40 from the first configuration to the second configuration. Alternatively, the support member 42 and the retaining member 44 may be separated and then positioned in the second configuration. In the first configuration, the upper surface 48 of the support member 42 may be generally transverse to the side surface 60 of the retaining member 44, as shown in FIG. 1. In the second configuration, the upper surface 48 of the support member 42 may be generally parallel to the side surface 60, as shown in FIG. 2B. In certain embodiments, the upper surface 48 of the support member 42 may contact the side surface 60 in the second configuration.

Figure 3:
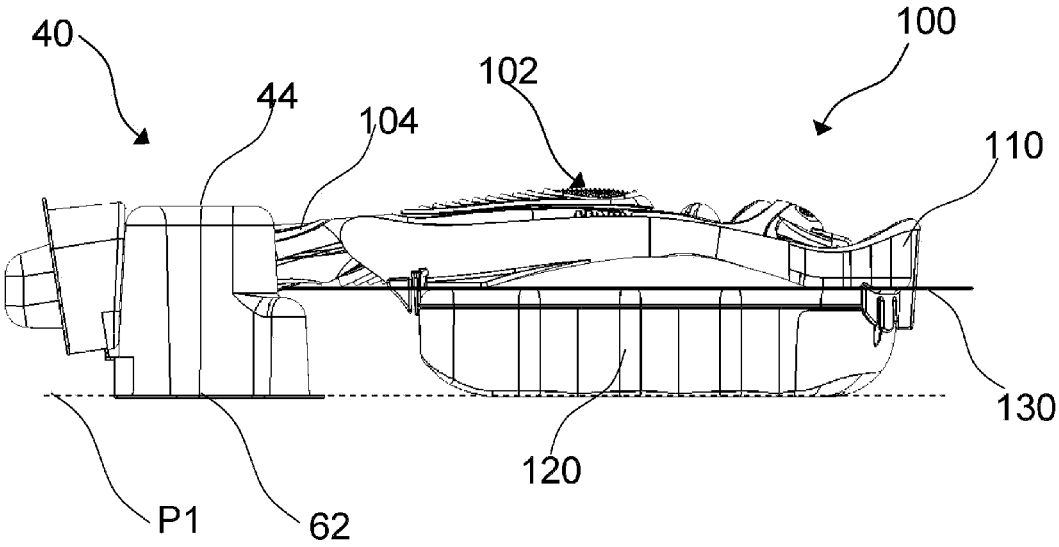
FIG. 3 is a side view of a consumer product with the stabilizing insert of FIG. 2B.

Referring to FIG. 3, a side view of the stabilizing insert 40 in the second configuration is illustrated with a consumer product 100. The consumer product 100 may include one or more items, for example, the consumer product 100 may include a shaving razor 102, a shaving tray 110, a cartridge organizer 120, and a display card 130. The shaving razor 102 may releaseably engage the cartridge organizer 120. The cartridge organizer 120 may hold and/or display one of more shaving cartridges. The display card 130 may be positioned between the shaving tray 110 and the cartridge organizer 120. The display card 130 may have various graphic design elements and relevant information about the consumer product 100. At least a portion of the shaving razor 102 may be removably retained by the shaving tray 110. The shaving tray 110 may be used to store the shaving razor 102 during periods of non use. The shaving razor 102 and/or the shaving tray 110 may be supported by both the stabilizing insert 40 and the cartridge organizer 120 so that the shaving razor 102 appears generally level when placed within the tub 12 or on a level surface. Accordingly, the base 62 of the support member 42 and a bottom surface 122 of the cartridge organizer 120 may rest on a common plane P1. The shaving razor 102 may have a handle 104 that is removably mounted to the retaining member 44 of the stabilizing insert 40. For example, the handle 102 may be removably secured within the recess 66 (see FIG. 2A) of the retaining member 44 to minimize movement of the shaving razor 102 during shipping and handling. Once purchased, a consumer can open the consumer product package 10 and easily remove the shaving razor 102 from the retaining member 44.

Figure 4:
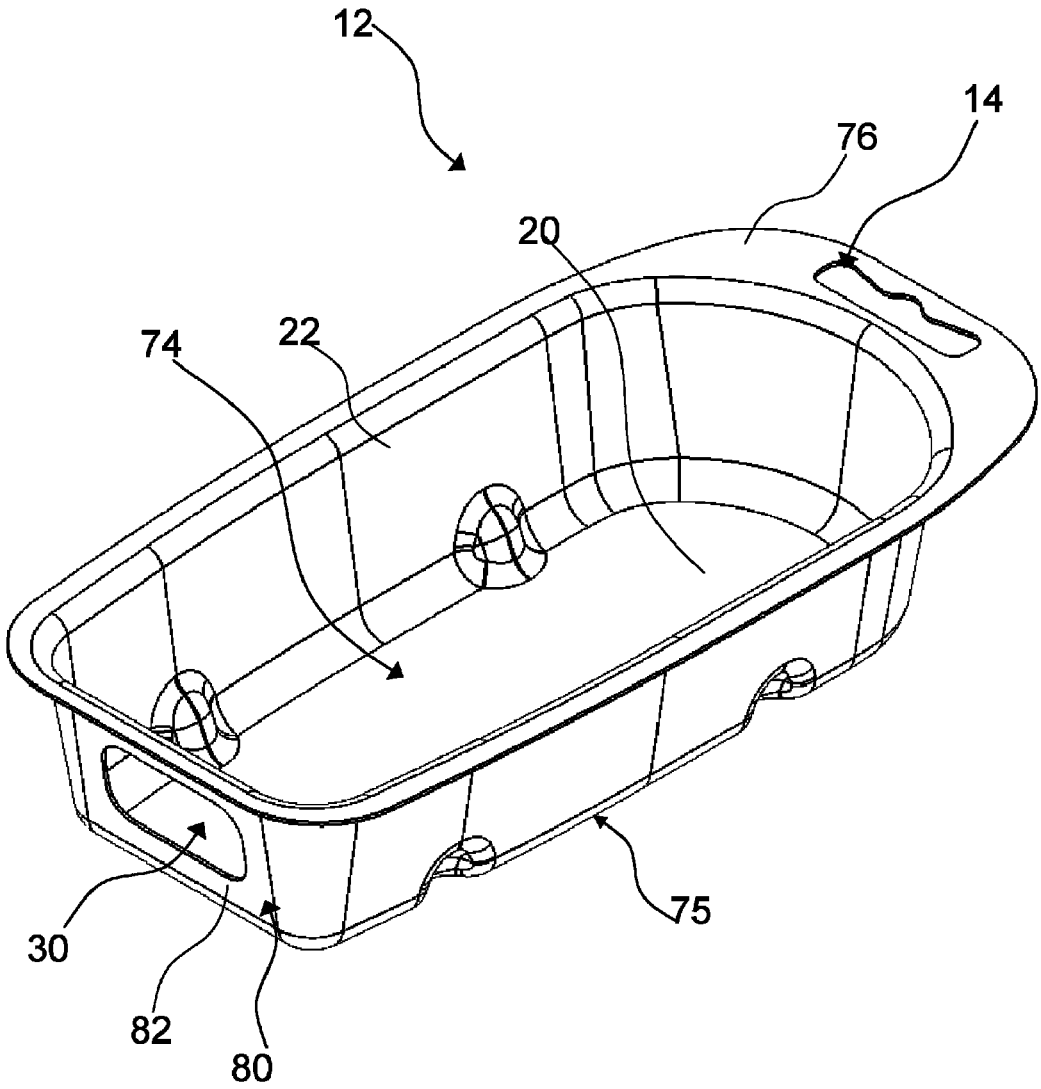
FIG. 4 is perspective view of a tub that may be incorporated into the display package of FIG. 1.

Referring to FIG. 4, a perspective view of the tub 12 is shown. The tub 12 may have a base 20 and a perimeter wall 22 that defines a cavity 74 dimensioned to receive the consumer product 100 (shown in FIG. 3) and at least a portion of the stabilizing insert 40. The base 20 may be generally flat to receive the stabilizing insert 40 within the cavity 74. An inner and/or outer surface of the base 20 may also accommodate packaging graphics and labeling. The base 20 may have a generally flat rear outer surface 75 to facilitate stacking the consumer product packages 10 on top of each or on a flat shelf. As will be explained in greater detail below, the generally flat rear outer surface 75 of the base 20 may facilitate indexing of the consumer product packages 10. However, the rear outer surface 75 need not be flat because the tub 12 may be vertically supported by the stabilizing insert 40 or suspended from a hook utilizing the hanging member 14. An outer flange member 76 may extend about the perimeter wall 22 of the tub 12. The outer flange member 76 may extend continuously around the perimeter wall 22 or may along or only along a portion of the perimeter wall 22. In certain embodiments, the outer flange member 76 may be generally parallel to the base 20 and provide an area for the cover 18 (see FIG. 1) to seal against. The outer flange member 76 may be laminated with the same or similar polymeric material (e.g., polyethylene terephthalate) as the cover 18 (see FIG. 1) for an improved seal (e.g., a required removal force greater than 10 Newtons). The outer flange member 76 may extend outward beyond the perimeter wall 22 by about 2 mm, 4 mm, or 6 mm to about 8 mm, 10 mm, or 12 mm.

The perimeter wall 22 may be generally transverse to the base 20. For example, the perimeter wall 22 may taper inwardly from the outer flange member 76 toward the base 20 at an angle greater than zero to about 3 degrees per side. However, it is understood a greater taper angle may be used if desired. The taper of the perimeter wall 22 may improve the manufacturability of the tub 12 (i.e., improved release of the tub 12 from a mold or tool). The perimeter wall 22 may define one or more openings 30 that are in communication with the cavity 74. In certain embodiments, the opening 30 may be located at a bottom portion (e.g., an end wall 80) of the tub 12 opposite the hanging member 14 and transverse to the base 20. The opening 30 may be dimensioned to receive the foot member 54 of the stabilizing insert 40. The opening 30 may be die cut or laser cut into the bottom portion 80 of the tub 12 (e.g., the end wall 82). Although only one opening 30 is shown, it is understood that the tub 12 may have a plurality of openings 30 each dimensioned receiving one or more feet 54.

Figure 5:
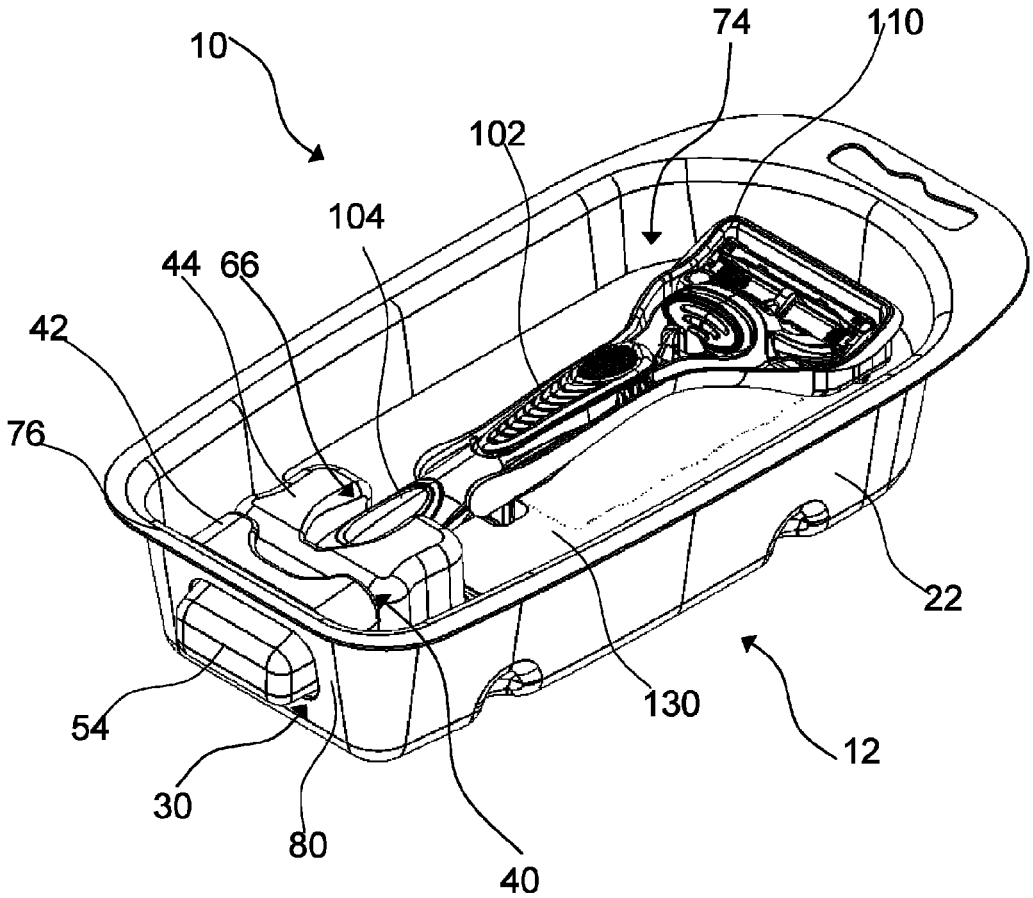
FIG. 5 is perspective view of the consumer product package of FIG. 1 without a cover.

Referring to FIG. 5, a perspective view of the consumer product package 10 is illustrated without the cover 18 for clarity. The stabilizing insert 40 may provide for multiple functions. For example, the stabilizing insert 40 may provide for a structural support of the consumer product package 10 to facilitate positioning the tub 12 in a substantially upright position. The stabilizing insert 40 may also provide a structural retaining feature within the tub 12 for the consumer product 100. At least a portion of the shaving razor 102 (e.g., the handle 104) may be engaged by the retaining member 44 to secure the shaving razor 102 to the stabilizing insert 40. For example, the handle 104 may be positioned within the recess 66 of the retaining member 44. The stabilizing insert 40 and the consumer product 100 may be disposed within the cavity 74. The stabilizing insert 40 may be flexed into the second configuration and the foot 54 may be positioned at least partially within and extend through the opening 30 of the tub 12. The foot 54 and the flange member 76 may support the tub 12 in a substantially upright (e.g., vertical) position. In certain embodiments, one or more feet 54 may support the consumer product package without the need of the flange member 76. The support member 42 may contact the perimeter wall 76 and the foot 54 may be spaced apart from (e.g., suspended above) the base 20 of the tub 12. The retaining member 44 may contact the base 74 to facilitate properly positioning the foot 54 within the opening 30. In certain embodiments, the hinge 46 (not shown) may press the consumer product 100 (e.g., the shaving tray 110) against the perimeter wall 22 to limit movement of the consumer product 100. The opening 30 and the foot 54 may be dimensioned to provide either a slip fit (i.e., opening 30 is larger than foot 54) or an interference fit (i.e., opening is smaller than foot 54). The cartridge organizer 120 may lay flat on the base 20 of the tub 12. The consumer product 100 may be held securely between the retaining member 44 of the stabilizing insert 40 and the perimeter wall 22 of the tub 12. The retaining member 44 and the perimeter wall 22 may minimize lateral movement (side to side and forward to back) of the consumer product 100. The consumer product 100 may also be held securely between the cover 18 and the base 20 of the tub 12 to limit up and down movement of the consumer product within the tub 12. In certain embodiments, the consumer product 100 may compressed between the cover 18 and the base 20 of the tub 12 to prevent movement of the consumer product during shipping and handling.

Figure 6:
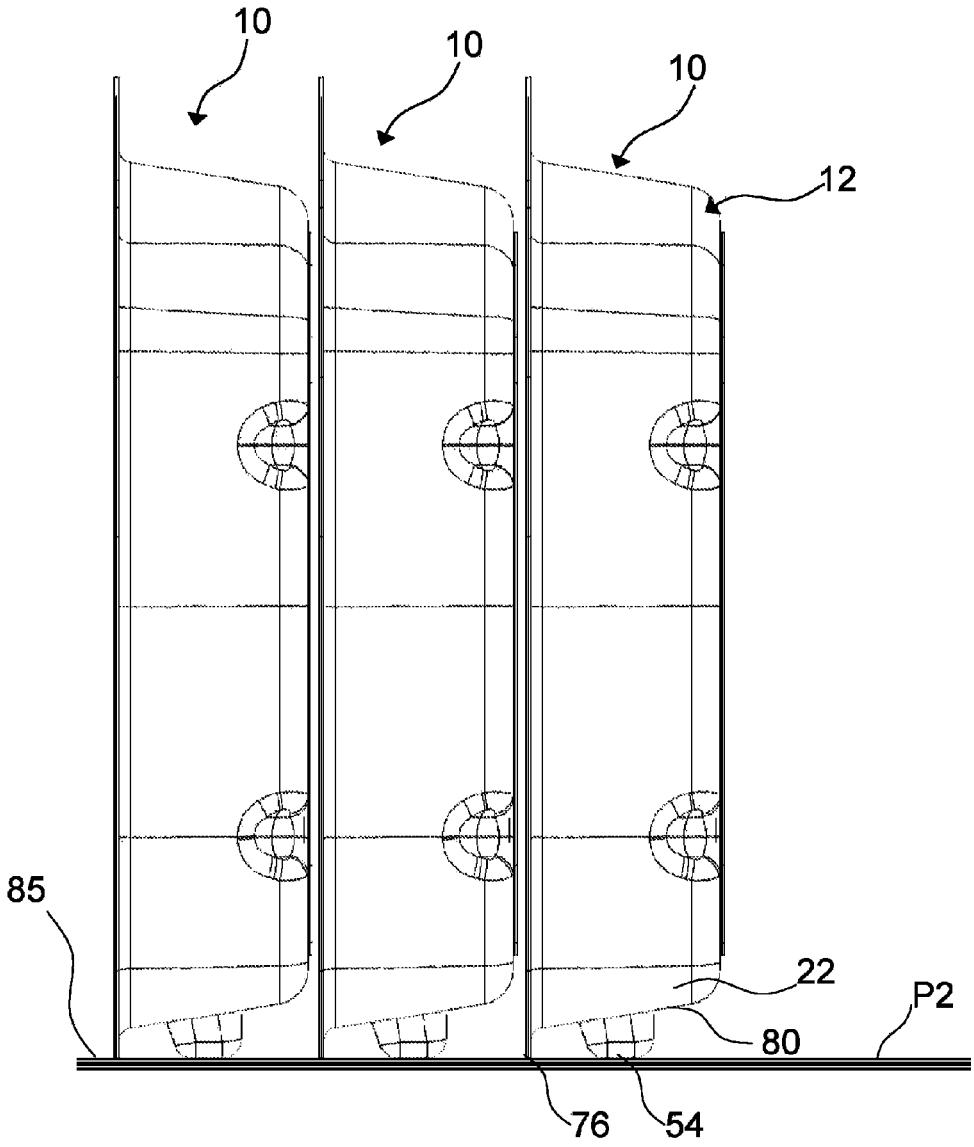
FIG. 6 is a side view of a plurality of consumer product packages arranged on a shelf.

Referring to FIG. 6, a plurality of consumer product packages 10 are shown in a freestanding and self indexing position on a shelf 85. Self indexing refers to maintenance of proper spacing on a store shelf, for example, when a pressure applicator moves the aligned packages forward in a display or on a shelf. In certain embodiments, the foot 54 may extend out from the perimeter wall 22 as far as the flange member 76 at the bottom portion 80 of consumer product package 10 (i.e., the foot 54 and the flange member 76 lay on a common plane P2). The foot 54 and the flange member 76 may be spaced apart from each other and support the consumer product package 10 on the shelf 85 in an upright or substantially upright position. The foot 54 may be configured to have a width, depth and height sufficient to allow the consumer product package 10 to be free standing on a support surface (e.g., a store shelf). The foot 54 may have a width of about 4 mm, 6 mm, or 13 mm to about 15 mm, 20 mm, or 25 mm and a length of about 10 mm, 15 mm, or 20 mm to about 30 mm, 40 mm, or 50 mm In certain embodiments, the width and length of the foot 54 may be greater than 50% of the width and length of the end wall 80. The foot 54 may have a depth (i.e., a distance the foot 54 extends beyond the perimeter wall 22 or the end wall 80 of the tub 12) of about 4 mm, 6 mm, or 8 mm to about 10 mm, 12 mm, or 14 mm It is understood that the depth of the foot 54 may be greater depending on the size and geometry of the tub 12. The consumer product package 10 may have the advantage of not requiring any additional assembly by store clerks position the tub 12 in a substantially upright vertical position. For example, some self supporting packages, such as the package generally disclosed in U.S. Pat. No. 3,785,546, require the store clerk to unfold a support structure that has been fixed to a wall of the package. These types of packages rely on the store clerk to assemble (e.g., unfold) the support structure properly. The support structure may also become damaged during assembly or as the product is handled by prospective consumers. In addition, these types of support structures take up additional space on the store shelf and do not allow the packages to be self indexing. For example, typical support structures do not allow for consistent spacing because the front of one package may not directly contact the rear face of an adjacent package. Furthermore, a pressure applicator may contact and deform the folding support structure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer product package comprising:

a tub having a base and a perimeter wall defining a cavity in communication with an opening that extends through the perimeter wall;

a consumer product disposed within the cavity; and a stabilizing insert at least partially disposed within the cavity, wherein the stabilizing insert has a retaining member removably securing the consumer product and a support member with a foot extending through the opening of the perimeter wall to facilitate positioning the tub in a substantially upright position.

2. The consumer product package of claim 1 wherein the tub has an outer flange member extending about the perimeter wall.

3. The consumer product package of claim 2 wherein the outer flange member is generally parallel to the base and the perimeter wall tapers inwardly from the outer flange to the base.

4. The consumer product package of claim 1 wherein the tub comprises renewable plant fibers.

5. The consumer product package of claim 1 wherein support member and the retaining member are joined by a flexible hinge.

6. The consumer product package of claim 5 wherein the support member has an upper surface and a side surface that is transverse to a side surface of the retaining member in a first configuration.

7. The consumer product package of claim 6 wherein the upper surface of the support member is generally parallel to the side surface of the retaining member in a second configuration.

8. The consumer product package of claim 7 wherein, the upper surface of the support member contacts the side surface of the retaining member in the second configuration.

9. The consumer product package of claim 2 wherein the foot and the outer flange member lay on a common plane.

10. The consumer product package of claim 2 wherein the foot member extends about 4 mm to about 14 mm from the perimeter wall and the outer flange member extends about 2 mm to about 12 mm from the perimeter wall.

11. The consumer product package of claim 2 wherein the foot and the outer flange member are spaced apart.

12. A package for a shaving razor comprising:

a tub having a base, an outer flange member, and a perimeter wall that tapers inward from the outer flange member to the base, the perimeter wall defining an opening a shaving razor disposed within the tub; and a stabilizing insert having a support member with a foot extending through the opening of the perimeter wall wherein the outer flange member and the foot support the tub in a substantially upright position.

13. The package of claim 12 wherein stabilizing insert has a retaining member at least partially disposed within the tub and the shaving razor is removably mounted to the retaining member.

14. The package of claim 12 wherein the foot and the outer flange member are spaced apart.

15. The package of claim 14 wherein the foot member extends about 4 mm to about 14 mm from the perimeter wall.

16. The package of claim 12 wherein the support member has a flange contacting the perimeter wall and the foot is spaced apart from the flange providing a gap extending around the foot.

17. The package of claim 12 wherein the support member contacts the perimeter wall and the foot member is spaced apart from the base of the pack.

18. The package of claim 12 wherein the retaining member contacts the base and the support member is spaced apart from the base.

19. A method of packaging a consumer product comprising:

at least partially securing a portion of a consumer product to a retaining member of a stabilizing insert having a support member with a foot;

placing the stabilizing insert within a tub having a base and a perimeter wall with a hole extending through the perimeter wall;

placing the stabilizing insert into the tub; and inserting the foot through the hole in the perimeter wall.

20. The method of claim 19 further comprising sealing a cover to an outer flange member of the tub.

* * * * *